United States Patent [19]

Anderson

[11] 4,135,263

[45] Jan. 23, 1979

[54] DUAL FLUSH TOILET MECHANISM

[76] Inventor: John K. Anderson, Richardson, Tex. 75080

[21] Appl. No.: 833,760

[22] Filed: Sep. 16, 1977

[51] Int. Cl.[2] ..... E03D 1/35

[52] U.S. Cl. ..... 4/324; 4/394

[58] Field of Search ..... 4/55, 67 R, 67 A, 56, 4/57 R, 324–326, 378, 394–396

[56] References Cited

U.S. PATENT DOCUMENTS

| | | | |
|---|---|---|---|
| 2,168,742 | 8/1939 | O'Neill et al. | 4/67 A X |
| 2,668,960 | 2/1954 | Barret-Lennard | 4/57 |
| 3,345,648 | 10/1967 | Rafferty | 4/67 A |
| 3,561,016 | 2/1971 | Reynolds | 4/67 A |

*Primary Examiner*—Charles E. Phillips

*Attorney, Agent, or Firm*—Crisman & Moore

[57] ABSTRACT

Apparatus operative to selectively discharge substantially all or only a predetermined portion of the water within the flush tank of a toilet. The apparatus includes an open ended float having selectively regulatable venting ports for controlling float weight and buoyancy by the water-air ratio therein. The float is constructed in a size adaptable to most existing commode flush tanks and is assembled therein by attachment directly to the flush valve thereof. The float water-air ratio is then set into the desired flush mode by selective venting of the ports whereby an unweighted float will permit a full flush and a water filled float will drive the flush valve into a premature closure for discharging only a portion of the water within the flush tank.

9 Claims, 5 Drawing Figures

DUAL FLUSH TOILET MECHANISM

BACKGROUND OF THE INVENTION

The invention relates to a toilet flush tank mechanism, and, more particularly, to a selectively bouyant float securable to the flush tank outlet valve adapted for permitting a dual flush system.

Conventional flush-tank toilets in homes and apartments are designed to use a standard volume of water which is considered necessary to flush the toilet bowl satisfactorily under maximum requirement conditions. Often less than maximum water volume can satisfactorily flush the toilet. Accordingly, one way to save water which is so wastefully flushed through toilets is to provide a selective flushing system which utilizes a full flush cycle for solid wastes and a partial flush for liquid wastes.

It may also be seen that in circumstances wherein a shortage of water exists or where it is necessary to use a minimum of water during flushing of a toilet, such as in droughts or when the toilet is connected to a cesspool system of sewerage, it is advantageous to provide dual flushing systems. Apparatus therein designed to provide dual flushing systems for flush-tank toilets may include multiple outlet ports, devices actuated by the fall of a separate float which exerts a force on the outlet valve, or devices actuated by the fall of the conventional float which controlls the inlet means and which by falling exerts a force on the outlet valve.

There are numerous disadvantages to these prior art devices. Some of the aforesaid mechanisms require more than one exterior flushing handle, others have multiple levers, still others employ cams and locking devices. Many of such mechanisms are unreliable in every day operations. Moreoever most of the aforesaid designs are costly and require considerable work, skill and tools for installation. It has also been found that such devices are often hard to operate due to poor leverage characteristics of the actuating mechanism thereof and multiple exterior actuating handle arrangements. Also such devices often include parts which are arranged in a manner wherein lateral forces are exerted on cooperating parts thereof in a manner to cause poor seating of the float means for stopping the flow of water at the termination of flushing cycle or binding of the actuating lever during movement thereof. A further problem has been the wear factor between moving parts which results in poor operation and readjustment of the relative positions of the cooperating parts of the flush tank.

It would be an advantage therefore to provide an improved dual-flush mechanism which fits any ordinary flush-tank toilet and overcomes the problems of the prior art. The apparatus of the present invention is designed for just such a purpose and includes a single open ended float housing directly securable to a commode flush valve and having selectively regulatable venting ports for controlling float weight and bouyancy by the water-air ratio therein. In this manner, additional levers and/or latches and other flush tank apparatus is not necessary to effect a dual-flush system. Similarly, the effective cost of such a device is drastically lowered as is the complexity of installation.

SUMMARY OF THE INVENTION

The invention relates to apparatus for selectively discharging substantially all or only a predetermined portion of the water within the flush tank of a toilet and includes a float housing having selectively regulatable venting ports. More particularly, one aspect of the invention includes an improved dual flush control device of the type coupled to the flush valve of commode tanks having a drain valve seat, a drain pipe connected to the seat, a float-type flexible valve, a secondary float connected to the valve so as to effectively ride on the flexible valve and sink it prior to the surface of the liquid in the flush tank reaching the top of the flexible valve. The improved device is comprised of an open ended float having a vented upper surface and trapped air space formed therein. The float is slidably connected to the flexible valve and constructed to selectively resist rapid changes of water level therein so as to allow its weight to ride upon the flexible valve to sink it prior to a complete flush.

In another aspect of the invention, the improved float is comprised of an inverted cupped shaped housing having a central tubular element for receiving the shaft of the flexible valve therethrough. The cup is vented at the top surface thereof with a tubular port which entraps air upwardly thereof. The entrapped air permits the float to rise to the surface of the tank between flushes. If the cup is held in the upward position during the flushing action by the tank lever, the commode tank water level drops below it and the cup water is permitted to escape. In this manner a normal flush is permitted.

In yet another aspect, the invention includes an inverted cup float having a tubular venting port of sufficient size for communicating with the atmosphere in such a manner as to permit the water level inside the float to equalize with that of the commode tank during a flush. In this manner the bouyancy of the cup is maintained during flushes to again permit complete commode tank draining.

BRIEF DESCRIPTION OF THE DRAWINGS

For a more complete understanding of the present invention, and, for further objects and advantages thereof, reference may now be had to the following description taken in conjunction with the accompanying drawings in which.

DETAILED DESCRIPTION OF THE DRAWINGS

Figure 1:
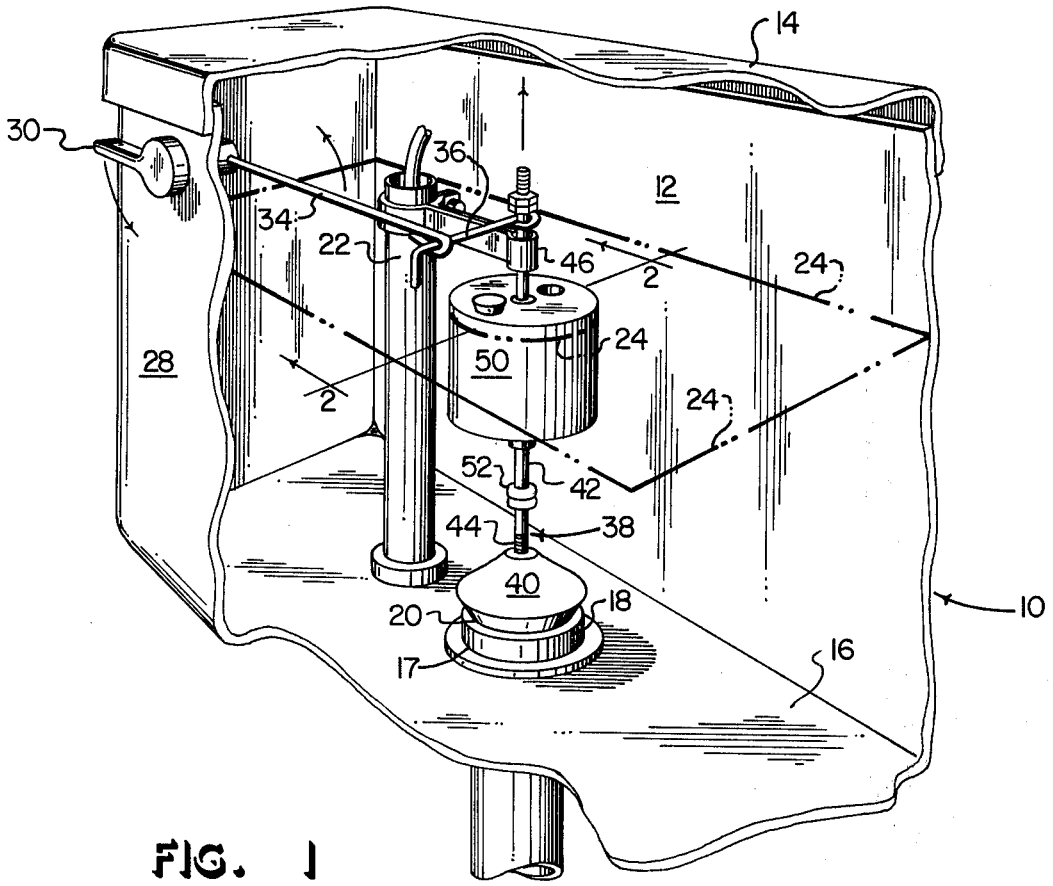
FIG. 1 is a perspective view of one embodiment of apparatus constructed in accordance with the principles of the present invention disposed within the flush tank of a conventional commode with portions thereof cut away to illustrate the operation thereof.

Referring first to FIG. 1, there is shown in fragmentary perspective a commode tank 10 of conventional design, wherein means are provided for selectively providing dual volume flush modes. The tank 10 as shown, includes an upwardly opening tank member 12 and a removable cover 14. The bottom of the tank is referred to by the reference number 16 and has an outlet opening 17 formed therethrough. The upper end of an outlet pipe 18 is secured through the outlet opening 17 and said pipe includes a valve seat 20 at its upper terminal end. Formed integrally with the upper end of the outlet pipe 18 is an overflow standpipe 22 and the upper end of the standpipe 22 projects to an elevation spaced above the upper water level 24. The elements of the intake valve, such as the lever arm float, being conventional, are not shown.

The front wall 28 of the tank member 12 has an opening (now shown) formed therethrough and a shaft portion (not shown) having a lever-type handle 30 on its outer end. An operating arm 34 is secured to the shaft of the handle 30 and extends across the upper area of the tank 10, generally parallel to the front wall 28. A second arm 36 generally interconnects arm 34 with a flush valve 38 in conventional commodes. Flush valve 38 in this particular embodiment is comprised of a flexible bulb 40 usually formed of rubber, or the like, which seats across the valve seat 20 and is removable therefrom via valve stem 42. The valve stem 42 is secured to the top of flush valve 40 with a threaded interconnection 44 and is supported thereabove through a support bracket 46 extending outward from overflow pipe 22. The conventional commode tank 10 is generally provided in such a configuration wherein actuation of the handle 30 lifts the lever arms 34 and 36 respectively to pull upwardly valve stem 42 and valve bulb 40 to permit flow of the water therein through drain pipe 18. The bulb 40 generally encapsulates air therewithin providing bouyancy and permitting the commode tank 10 to complete the flush before the weight of the valve 38 causes it to seat and seal the tank for refilling.

Figure 2:
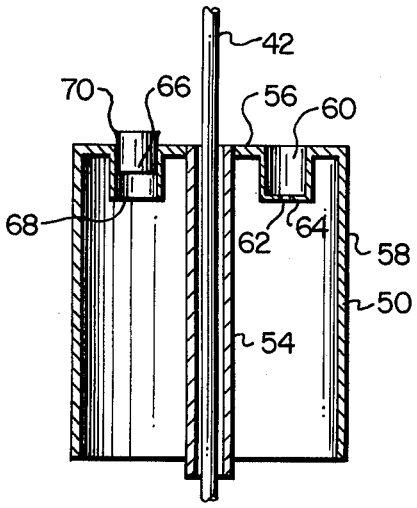
FIG. 2 is an enlarged side elevational, cross-sectional view of the float housing shown in FIG. 1 taken along lines 2—2 thereof.

In accordance with the principles of the present invention apparatus is provided for securement to the flush valve 38 and includes a float housing 50 formed of plastic, or the like, slidably mounted upon the valve stem 42. A movable stop 52 is provided beneath the housing 50 and upon the stem 42 for permitting selectivity of float movement and variations in flush mode characteristics. Referring now to FIG. 2, there is shown a cross-sectional elevation of the housing 50 wherein it may be seen that a central tubular element 54 is provided therein and sealably secured through the upper surface 56 thereof. The tube 54 is adapted for receiving the valve stem 42 therethrough for centralized, slidable engagement therewith. The housing 50 is further comprised of generally cylindrical side walls 58, sealably depending from the upper surface 56 for encapsulating a selected volume of air and water therein.

Still referring to FIG. 2, it may be seen that the housing 50 is provided with a vented, or ported upper surface 56. In the particular embodiment of housing 50 shown in FIGS. 1 and 2 a pair of tubular ports are provided. A first port 60 is formed with a small aperture or orifice 62 formed in the bottom surface 64 thereof. A second port 66 is also provided on the surface 56 with a larger aperture 68 provided along the lower recesses thereof. A stopper, or sealing element 70 is shown to be received within the port 66 for sealing same against fluid flow during operation within the commode tank 10. The stopper 70 may be seen to be preferably of a size adaptable for insertion in either of the ports 60 or 66 for selectively regulating the operation of the housing 50.

In operation, the ports of the housing 50 selectively vent the inner volume thereof with the air within the commode tank 10. When the port 66 is sealed via stopper 70 fluid such as air and water is permitted to flow into and out of the housing 50 in a restricted manner through orifice 62. When the stopper 70 is sealably engaged in port 60 fluid is permitted to flow relatively unobstructed into and out of the housing 50 through orifice 68. The differential air flow characteristics provided with the ports 60 and 66 respectively permits selectivity in the desired flush mode. By permitting fluid to flow through port 66, the housing 50 merely becomes a passive element riding upon valve stem 42 and producing negligible effect upon the flushing operation of the valve 38. When port 66 is sealed from the environment air is permitted only to enter the housing 50 through orifice 62 whereby the housing 50 effectively functions as a weighted element during the flushing operation, as described in more detail below.

Figure 3:
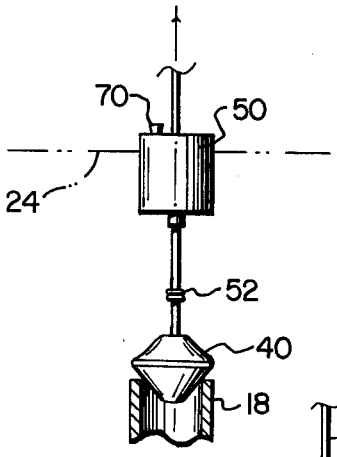
FIGS. 3, 4 and 5 are fragmentary side elevational views of the apparatus of FIG. 1 illustrating in a three step sequence, the functioning of the present invention through one mode of operation.
Figure 4:
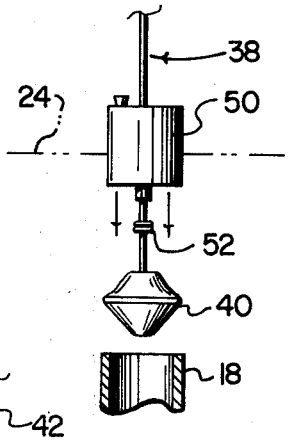
Figure 5:
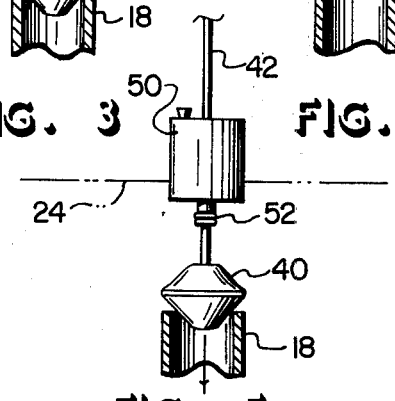

The housing 50 remains bouyant within the tank 10 because a trapped air space is provided above the bottom surfaces of the tubular ports 60 and 66 from which air is not permitted to escape in either mode of operation. In this manner, housng 50 will always float to the top surface of the water level 24 within the commode tank 10 if permitted. The water level within the housing 50 will also be substantially equivalent to that on the outside thereof when given sufficient time to equalize; either slowly through the venting or orifice 62 or rapidly through aperture 68. Once the handle 30 is actuated and the bulb 40 is removed from the valve seat 20, the water level 24 will begin to drop in tank 10, with the water egressing through the outlet pipe 18. The bouyancy of the bulb 40 will normally hold it above pipe 18 during the flushing operation. As the water level drops, the housing 50 will also begin to fall as its weight, with port 66 sealed, will be substantially increased by the trapped water therein. Since the orifice 62 is of a restricted size, the inner volume of the housing 50 will not permit rapid water level equalization with that outside. In ths manner the housing 50 will acquire substantial weight for driving the valve stem 42 and bulb 40 downwardly along with the water level 24 as it egresses. When the stop 52 engages the housing 50, and particularly the lower end of the tubular element 54, the bulb 40 will be driven back into the valve seat 20 for premature termination of the flush. Referring now to FIGS. 3–5, the above-referred to sequence is more clearly illustrated. In FIG. 3 it may be seen that the stopper 70 is disposed within the unrestricted port 66 for limited volume flushing. In this configuration, the housing 50 floats atop water level 24 with water level therein substantially equivalent thereto. In FIG. 4 the flushing actuation has been set into motion with drainage of the water from the commode tank 10 through the outlet pipe 18 with the bulb 40 being in an upwardly disposed position therefrom. The weight of the trapped water within the housing 50 and above the water level 24 then causes the housing 50 to move downwardly upon the valve stem 42 until coming in contact therewith.

In FIG. 5 the weight of the water filled housing 50 against the stop 52 has driven the valve stem 42 and bulb 40 back into the valve seat 20 to prematurely terminate the flush at the water level shown therein and some degree less than that normally provided in a full flush operation. It may be seen that the above-described flush volume is selectable via the position of the stop 52 upon the valve stem 42. It may also be seen that a full volume flush may be achieved not only by opening port 66, but also by holding handle 30 downwardly until the water level 24 drops below the bottom surface of the housing 50. In this manner, with housing 50 and bulb 40 upwardly supported by the handle 30 and respective lever arms, the water egresses until the housing 50 is vented from its open bottom whereby water is permitted to immediately escape.

It may further be seen that the above-described apparatus is equally adaptable to commode tanks 10 of different varieties. For example, in some commode tank structures the flush valve 38 is comprised of a "flapper" type bulb wherein a rigid valve stem 42 is not utilized. Such a commode structure is shown and described in U.S. Pat. No. 3,156,930 issued to C. J. Moutton on Nov. 17, 1964. As shown therein, the conventional valve bulb may be pivoted about the drain pipe and actuated with a chain, or the like. In such an application, the apparatus of the present invention could be easily adaptable by supporting the housing 50 above the valve bulb in a manner similar to that shown and described above.

It is thus believed that the operation and construction of the dual flush toilet mechanism of the present invention will be apparent from the foregoing description. While the apparatus shown and described has been characterized as being preferred, it will be obvious that various changes and modifications may be made therein without departing from the spirit and scope of the invention as defined in the following claims.

What is claimed is:

1. An improved dual volume flush control device of the type coupled to the flush valve of commode tanks having a drain valve seat, a float-type flexible valve including a valve stem, said valve adapted for engaging said valve seat, a secondary float mounted on said valve stem so as to effectively ride on said flexible valve and sink it prior to the surface of the water in said flush tank reaching the top of said flexible valve, wherein the improvement comprises said secondary float being constructed in a cupshaped configuration disposed on said stem in an inverted position having an open ended bottom and controllably vented top, said cup entrapping water and air therewithin and including an upper orifice for communicating with the atmosphere and permitting the entrapped water in the cup to weight said flexible valve in one mode of operation and to vent and selectively equalize with the water level of the commode tank in a second mode of operation, while in either mode maintaining said entrapped air within said float.

2. The apparatus set forth in claim 1 wherein said secondary float is comprised of an inverted cup having an open bottom portion and a central, depending tubular passage therethrough, said tubular passage extending substantially the length of said float and beneath the flush tank water level for sealably containing the entrapped air and water therein.

3. The apparatus set forth in claim 2 wherein said upper orifice in said top includes a depending tubular member entrapping air upwardly, of the lower end of said tubular member, which entrapped air imparts bouyancy to said inverted cup.

4. The apparatus set forth in claim 3 wherein said inverted cup includes a pair of orifices in said top wherein the first of said orifices being openly vented to the atmosphere for unrestricted fluid flow substantially eliminating entrapment of water and air below said orifice and a second of said orifices is vented to the atmosphere with a restricted air flow port, wherein entrapment of water and air below said orifice is substantially maintained during the flushing operation when said first orifice is sealed from the atmosphere.

5. The apparatus as set forth in claim 1 wherein said device further includes a stop element adjustably disposed between said secondary float and said flexible valve for engaging said central depending tubular passage and controlling the depth of which said secondary float may fall before riding upon said flexible valve.

6. An actuating mechanism for the flushing system of dual flush type toilet comprising:

a water storage tank;

a fluid inlet communicating with said tank and controlled by an inlet valve actuated by the water level in said tank;

an overflow tube operationally connected to a fluid outlet in said tank and communicating with the toilet;

an outlet valve including a float mounted on a stem, said float adapted for sealable engagement with an outlet port in communication with the toilet;

means connecting said outlet valve and a flushing actuator arranged so that when the flushing actuator is operated said outlet valve is opened and water is permitted to egress into the toilet; and a flotation housing comprising an inverted cup mounted on said stem and having an open bottom and closed top, said cup entrapping air and water therein through its inverted configuration, said top including an upper orifice selectively venting at least a portion of said entrapped air and water through the top for controlling the egressing of said water through said open bottom and the resulting weight of said cup, said upper orifice being located in said cup such that a fixed amount of entrapped air will be prevented from venting during operation.

7. The mechanism as set forth in claim 6 wherein said housing includes an open ended, generally cylindrical cup formed of polyprolene.

8. The mechanism as set forth in claim 7 wherein said inverted cup includes a central tubular member depending therein and receiving an outlet valve connection element longitudinally therethrough in slidable engagement therewith, said tubular member depending below the water level of said tank for entrapping air and water therearound and within said cup.

9. The mechanism set forth in claim 6 wherein said upper orifice is of a sufficient size to permit rapid venting of entrapped air through said top for permitting flow of water from said open cup bottom and rapid water level equalization between said housing and the water level in the water tank for normal flushing, and said orifice being selectively closable to substantially maintain said entrapped water for premature flush termination.

* * * * *